US012692701B2

(12) United States Patent
Bielkov et al.

(10) Patent No.: US 12,692,701 B2
(45) Date of Patent: Jul. 28, 2026

(54) ELONGATED CEILING GRID MEMBER AND CEILING GRID ASSEMBLY INCLUDING A PLURALITY OF THE ELONGATED CEILING GRID MEMBER

(71) Applicant: TATE ACCESS FLOORS, INC., Jessup, MD (US)

(72) Inventors: Maksym Bielkov, Bray (IE); Christopher Buss, Washington, DC (US); Lucas Michael Fox, Baltimore, MD (US)

(73) Assignee: TATE ACCESS FLOORS, INC., Jessup, MD (US)

( * ) Notice: Subject to any disclaimer, the term of this patent is extended or adjusted under 35 U.S.C. 154(b) by 223 days.

(21) Appl. No.: 18/799,228

(22) Filed: Aug. 9, 2024

(65) Prior Publication Data

US 2026/0043233 A1 Feb. 12, 2026

(51) Int. Cl.
*E04B 9/10* (2006.01)
*E04B 9/14* (2006.01)

(52) U.S. Cl.
CPC . *E04B 9/14* (2013.01); *E04B 9/10* (2013.01)

(58) Field of Classification Search
CPC . E04B 9/064; E04B 9/10; E04B 9/127; E04B 9/242; E04B 9/006; E04B 9/14; E04B 9/068
See application file for complete search history.

(56) References Cited

U.S. PATENT DOCUMENTS 4,548,010 A * 10/1985 Hintsa ..... E04B 9/26 52/800.11
5,433,048 A * 7/1995 Strasser ..... E04F 19/0436 52/506.07
5,572,844 A * 11/1996 Stackenwalt ..... E04B 9/127 52/506.07
7,886,496 B1 * 2/2011 Spransy ..... E04B 9/127 52/506.07
10,808,401 B2 * 10/2020 Awasthi ..... E04B 9/0428
D1,021,153 S * 4/2024 Shaffer ..... D25/133
2008/0148668 A1 * 6/2008 Jahn ..... E04B 9/068 52/506.07
2013/0308303 A1 * 11/2013 Greenholt ..... F21S 8/063 362/150
2016/0017604 A1 * 1/2016 White ..... F21S 4/28 52/28
2017/0292269 A1 * 10/2017 Tornqvist ..... E04B 9/064
2018/0100305 A1 * 4/2018 Curtin ..... E04B 9/20
2024/0068632 A1 * 2/2024 Large ..... F21S 8/026

FOREIGN PATENT DOCUMENTS

WO 2025/088008 A1 5/2025

OTHER PUBLICATIONS

Jan. 1, 30, 2026 Extended European Search Report issued in EP Application No. 25194891.5.

* cited by examiner

*Primary Examiner* — Paola Agudelo
(74) *Attorney, Agent, or Firm* — Oliff PLC

(57) ABSTRACT

An elongated ceiling grid member including (1) a threaded member receptacle having a pair of parallel, spaced side walls that are threaded to receive and retain a first threaded member, (2) a vertical wall parallel to and spaced laterally from the pair of side walls, (3) a slanted wall extending outwardly and downwardly from the pair of side walls and joined to the vertical wall and (4) a lower portion at the bottom of the vertical wall and configured to support a ceiling tile.

4 Claims, 14 Drawing Sheets

ELONGATED CEILING GRID MEMBER AND CEILING GRID ASSEMBLY INCLUDING A PLURALITY OF THE ELONGATED CEILING GRID MEMBER

FIELD OF THE INVENTION

This invention relates to elongated ceiling grid members and to ceiling grid assemblies that include the elongated ceiling grid members and are attached to and suspended from ceilings of rooms and other building spaces, such as office spaces, storage areas, and data centers, to function as the framework for directly and/or indirectly supporting other structural members and/or room or building accessories. In particular, this invention relates to elongated ceiling grid members (1) that can be connected on their ends to form the perimeter of a ceiling grid assembly consisting of parallel and perpendicular rows of elongated ceiling grid members and (2) to which the other structural members and/or room or building accessories can be attached.

BACKGROUND OF THE INVENTION

Ceiling grid assemblies comprised of a plurality of elongated ceiling grid members connected on their ends to form parallel and perpendicular rows of the elongated ceiling grid members have been in use for decades. Those ceiling grid assemblies are usually directly attached to and suspended from the structure comprising the ceiling of a room or other building space, such as a concrete slab. The elongated ceiling grid members of those ceiling grid assemblies directly or indirectly support other structural members and room or building accessories, such as light fixtures, HVAC conduits, sprinkler systems, etc., in the rooms or other building spaces in which they are installed.

Those ceiling grid assemblies include elongated ceiling grid members that form the perimeters of the ceiling grid assemblies. Those "perimeter" elongated ceiling grid members may be different than the elongated ceiling grid members forming the "interior" of the ceiling grid assembly because they may be configured differently to form the perimeters of the ceiling grid assemblies. In addition, the "perimeter" elongated ceiling grid members are usually only connected (1) perpendicularly to each other to form a corner of the ceiling grid assembly or (2) in a T formation including two of the "perimeter" elongated ceiling grid members, arranged end-to-end, and one of the "interior" elongated ceiling grid members arranged perpendicularly to the two "perimeter" elongated ceiling grid members.

In many applications, all elongated ceiling grid members, including the "perimeter" elongated ceiling grid members, and ceiling grid assemblies must support ever increasing loads, weight-wise. That is, rooms and other building spaces that include those elongated ceiling grid members and ceiling grid assemblies have an ever increasing number of structural members and room or building accessories to be supported by the elongated ceiling grid members and ceiling grid assemblies in those rooms and other building spaces, which ever increasing number of structural members and room or building accessories increases the load on those elongated ceiling grid members and ceiling grid assemblies. Thus, there is a need in the art for elongated ceiling grid members, including "perimeter" elongated ceiling grid members, and ceiling grid assemblies that have increased strength to adequately support those increased loads.

This invention addresses those needs, as well as other needs that are readily apparent to those of skill in the art.

SUMMARY OF THE INVENTION

The elongated ceiling grid members of this invention have a longitudinal axis in a longitudinal direction. Some embodiments of the elongated ceiling grid members include (1) a threaded member receptacle having a pair of spaced side walls (a) extending in parallel in the longitudinal direction and spaced in a lateral direction perpendicular to the longitudinal direction and (b) threaded to threadedly receive and retain a first threaded member, (2) a vertical wall (a) parallel to the pair of spaced side walls and (b) spaced from the pair of spaced side walls in the lateral direction, (3) a first slanted wall (a) extending outwardly in the lateral direction and downwardly in a vertical direction perpendicular to the longitudinal direction and the lateral direction from one of the pair of spaced side walls and (b) joined to the vertical wall and (4) a lower portion (a) at a bottom of the vertical wall in the vertical direction, (b) extending inwardly from the vertical wall in the lateral direction and (c) configured to support a ceiling tile. The first slanted wall may extend from the one of the pair of spaced side walls between uppermost and lowermost edges of the one of the pair of spaced side walls.

Certain embodiments of this invention may include a second slanted wall joined (a) at a first end to the one of the pair of spaced side walls below the joinder of the first slanted wall to the one of the pair of spaced side walls in the vertical direction and (b) at a second end to the vertical wall below the joinder of the first slanted wall to the vertical wall in the vertical direction.

DETAILED DESCRIPTION OF EMBODIMENTS

Figure 1:
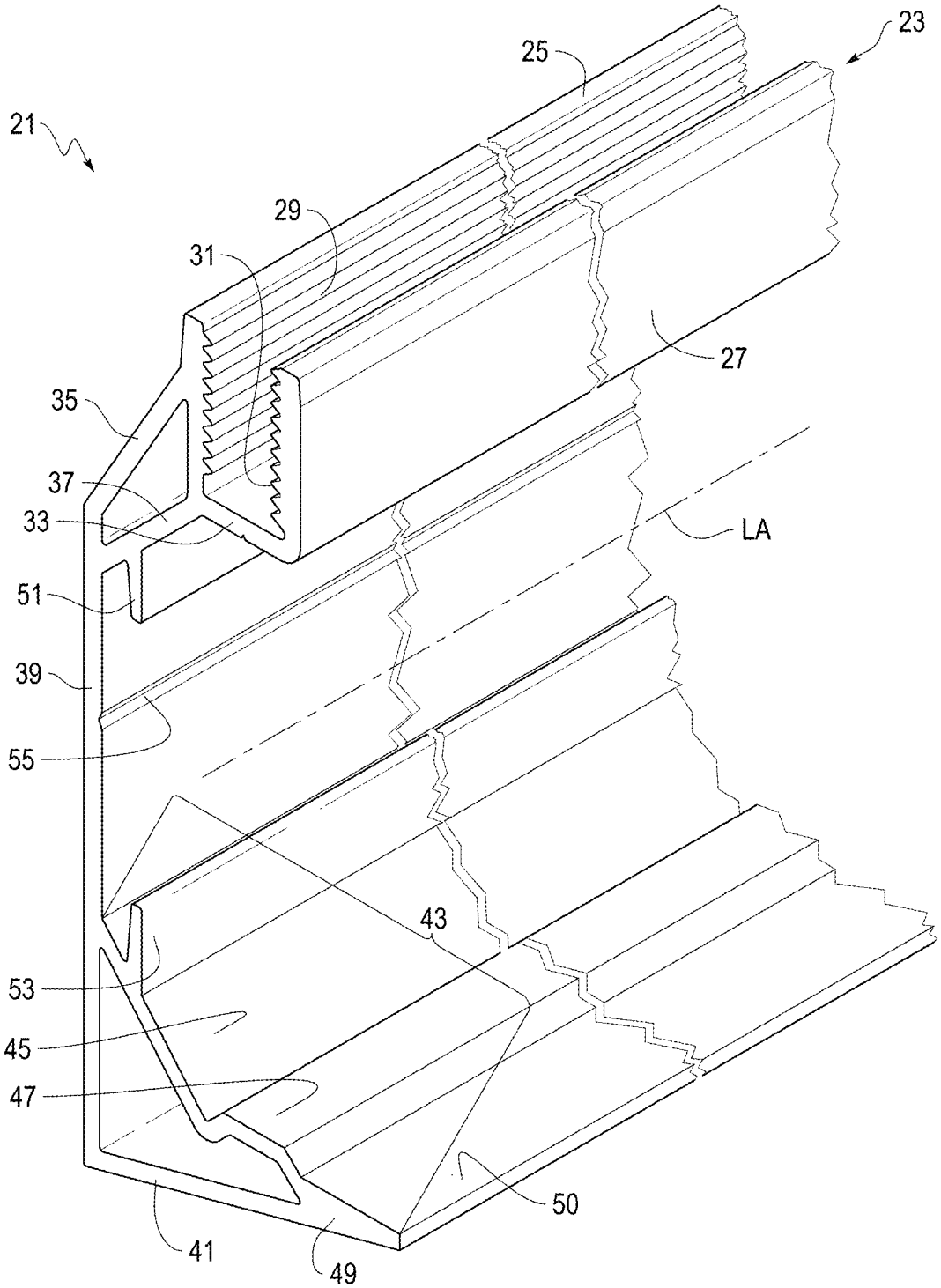
FIG. 1 is a side, perspective view of an elongated ceiling grid member of one embodiment of this invention.
Figure 2:
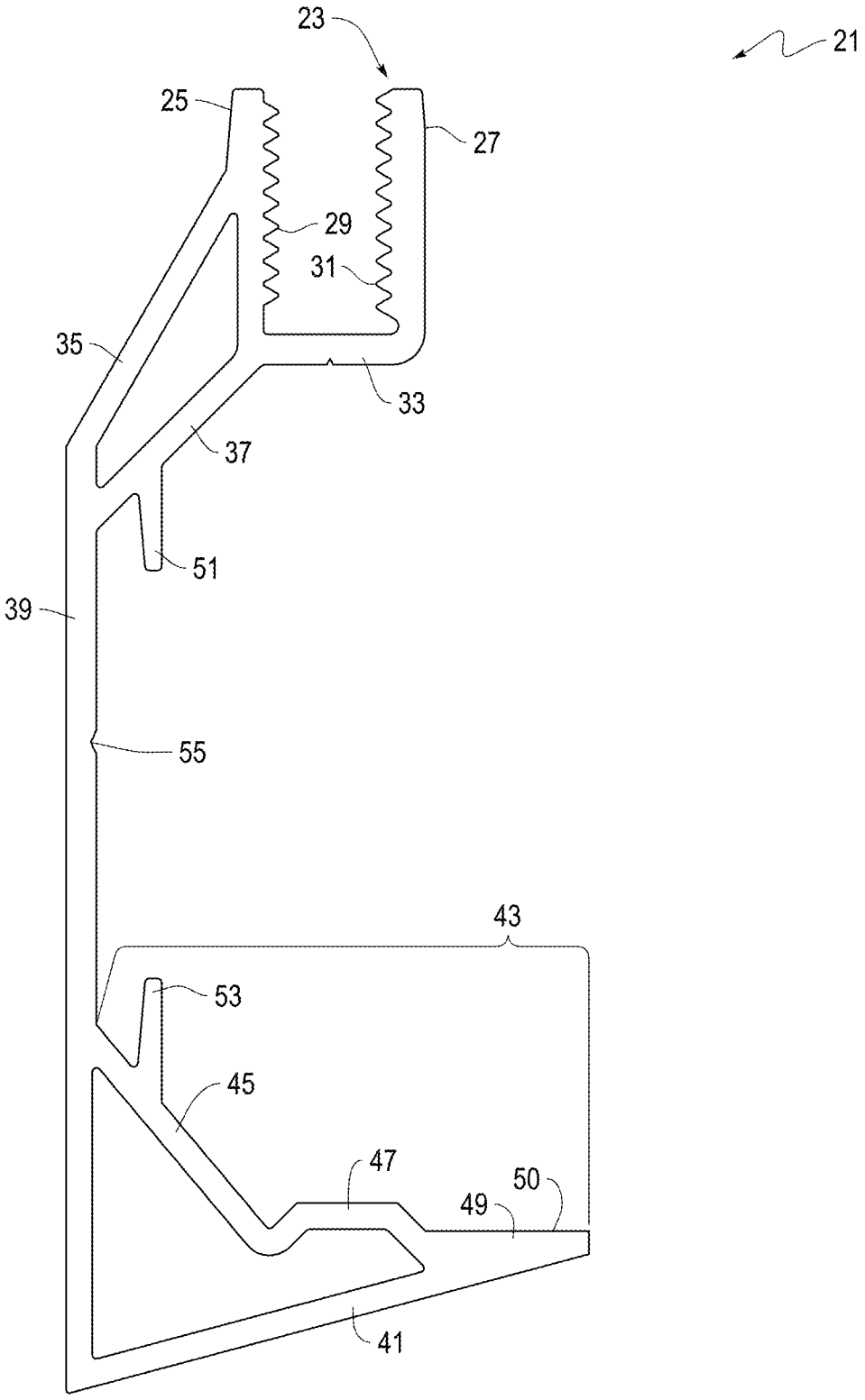
FIG. 2 is a front, elevation view of the elongated ceiling grid member illustrated in FIG. 1.
Figure 3:
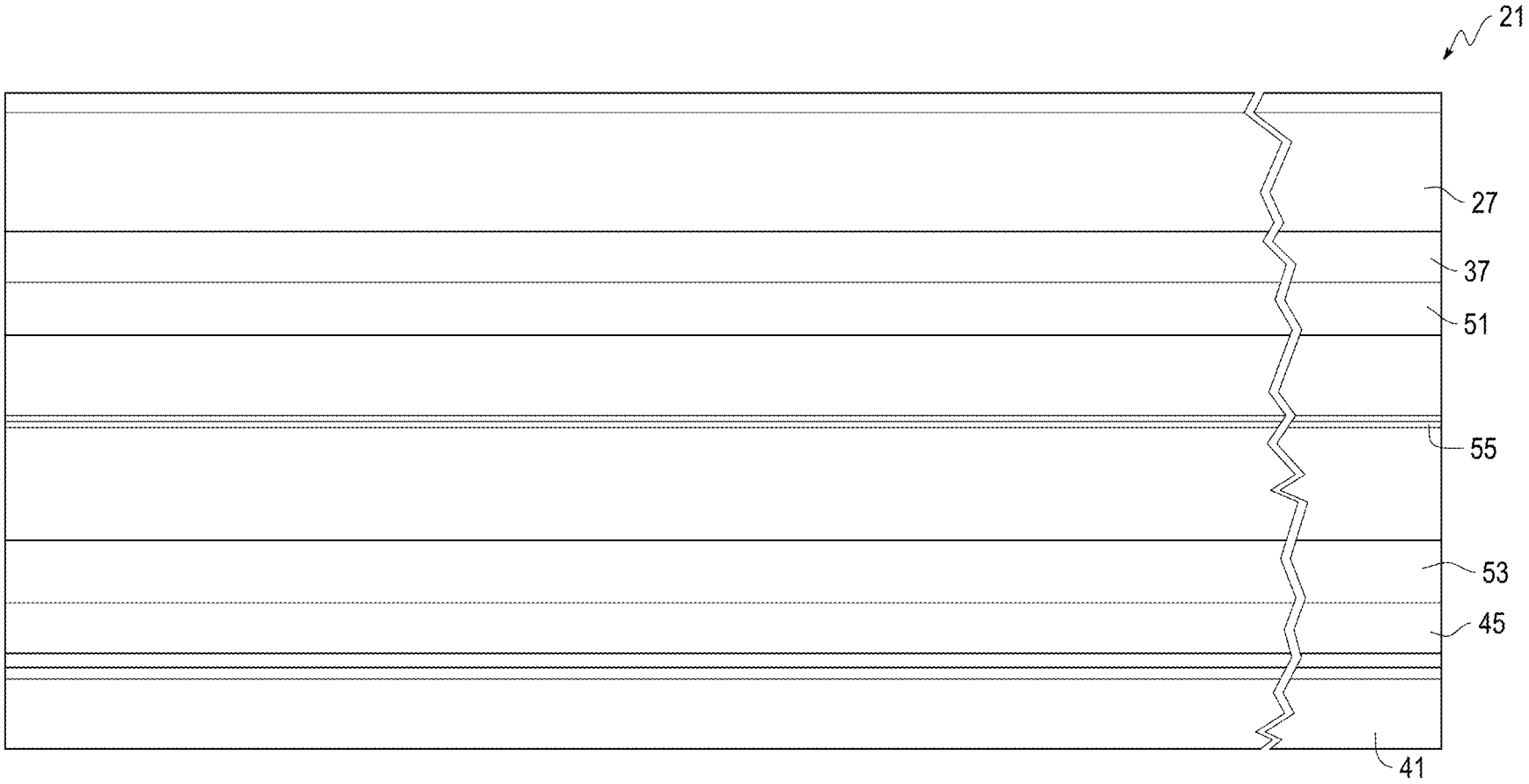
FIG. 3 is a side, elevation view of the elongated ceiling grid member illustrated in FIGS. 1 and 2.
Figure 6:
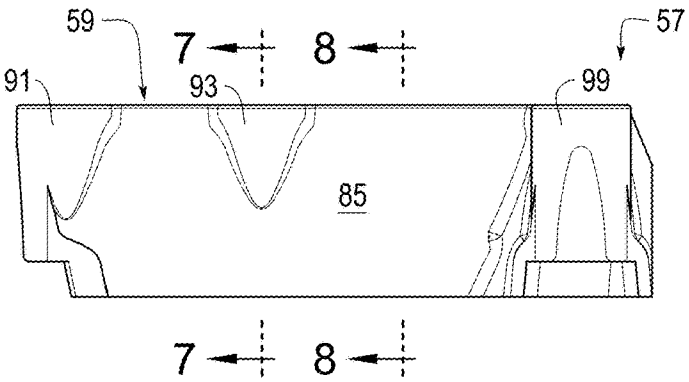
FIG. 6 is a side, elevation view of the corner connector illustrated in FIGS. 4 and 5.
Figure 8:
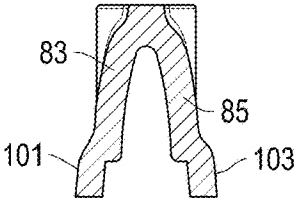
FIG. 8 is a cross-sectional view of the corner connector illustrated in FIGS. 4-7 taken along line 8-8 of FIG. 6.
Figure 7:
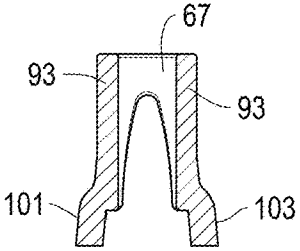
FIG. 7 is a cross-sectional view of the corner connector illustrated in FIGS. 4-6 taken along line 7-7 of FIG. 6.
Figure 4:
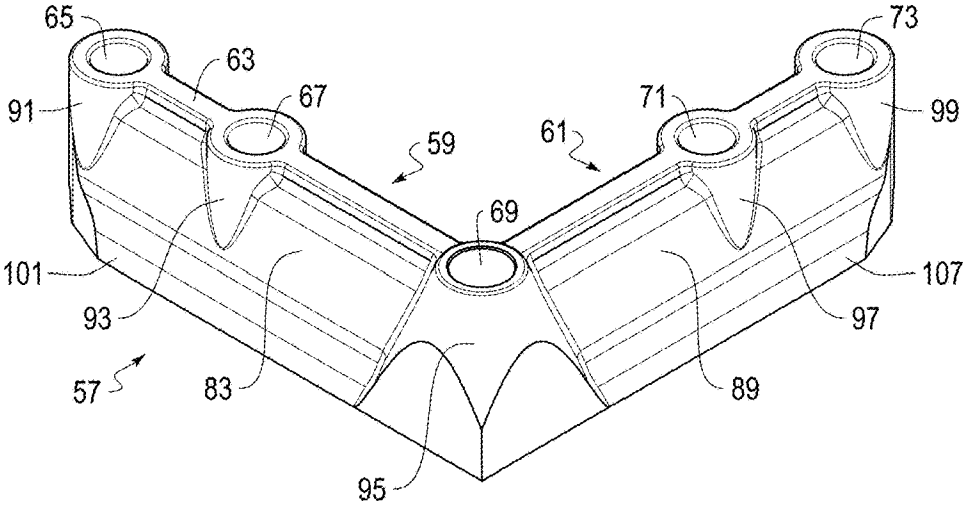
FIG. 4 is a top, perspective view of an embodiment of a corner connector that can connect two of the elongated ceiling grid member illustrated in FIGS. 1-3 perpendicular to each other.
Figure 5:
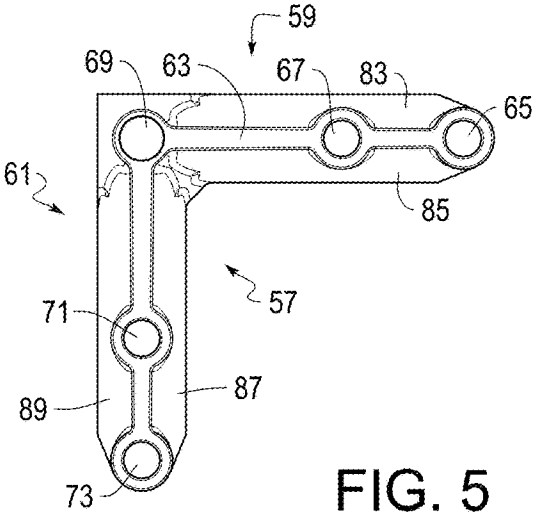
FIG. 5 is a top view of the corner connector illustrated in FIG. 4.
Figure 10:
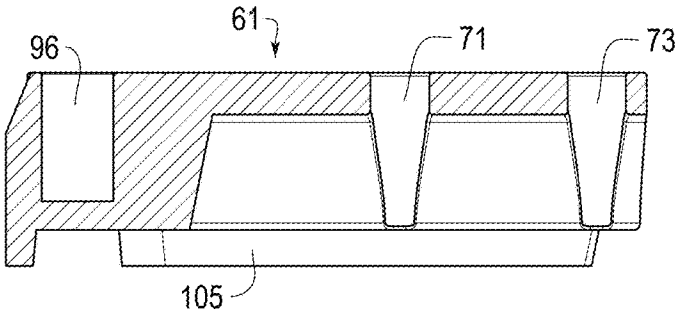
FIG. 10 is a cross-sectional view of the corner connector illustrated in FIGS. 4-9 taken along line 10-10 of FIG. 9.
Figure 9:
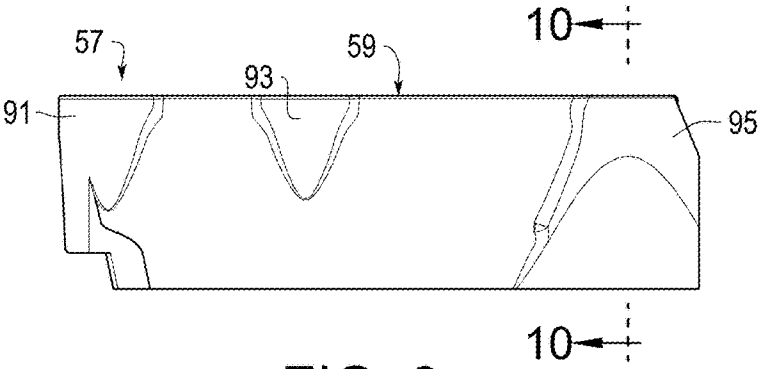
FIG. 9 is another side, elevation view of the corner connector illustrated in FIGS. 4-8.
Figure 11:
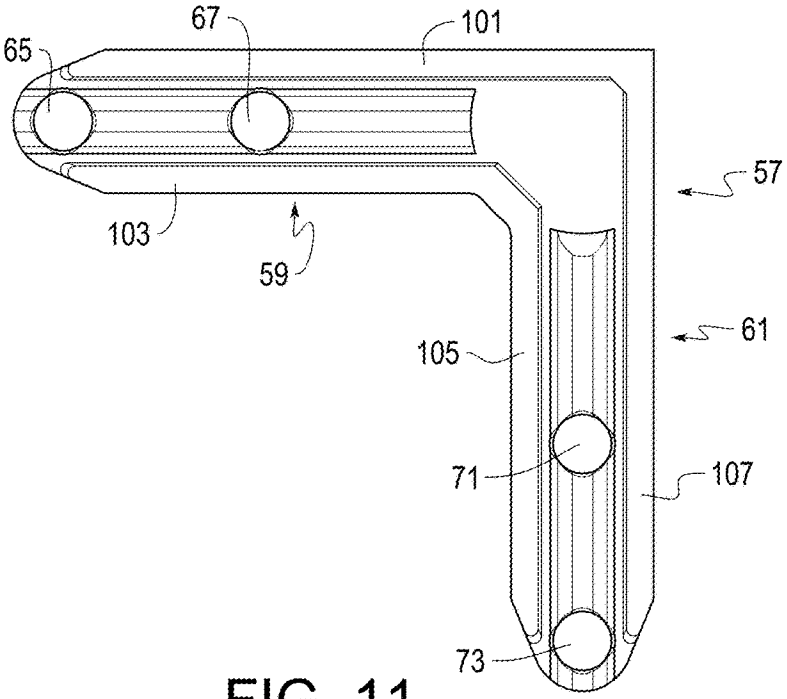
FIG. 11 is a bottom view of the corner connector illustrated in FIGS. 4-10.

As stated, one embodiment of an elongated ceiling grid member of this invention is illustrated in at least FIGS. 1-3, elongated ceiling grid member 21. Elongated ceiling grid member 21 is configured to be a perimeter member of a ceiling grid assembly.

Elongated ceiling grid member 21 has longitudinal axis LA along its length in a longitudinal direction and includes threaded member receptacle 23, outer slanted wall 35, inner slanted wall 37, vertical wall 39, bottom wall 41, lower slanted wall 43, finger or tab 51 and finger or tab 53.

Threaded member receptacle 23 includes side wall 25, side wall 27 and bottom wall 33. In this embodiment of the invention, side walls 25 and 27 extend in parallel in the longitudinal direction and are spaced in a lateral direction perpendicular to the longitudinal direction. Bottom wall 33 extends between and connects side wall 25 and side wall 27, at or near their lowermost edges, as shown in FIGS. 1 and 2.

Side wall 25 includes internal threads 29 and side wall 27 includes internal threads 31.

Internal threads 29 and internal threads 31 are on parallel vertical surfaces and offset vertically so that a threaded member can be threadably received and retained between internal threads 29 and internal threads 31, as discussed below and illustrated in FIGS. 12 and 13.

While, in this embodiment of the invention, threaded member receptacle 23 includes parallel side walls 25 and 27 with internal threads 29 and 31, respectively, the elongated ceiling grid members of other embodiments of this invention may include structure other than threaded parallel walls that can receive and retain a threaded or other member.

Outer slanted wall 35 extends between and connects side wall 25 and the top edge of vertical wall 39, as shown in FIG. 2. Outer slanted wall 35 extends outwardly in the lateral direction and downwardly in a vertical direction from side wall 25. In this embodiment of the invention, the top end of outer slanted wall 35 intersects side wall 25 between the top and bottom edges of side wall 25.

Also in this embodiment of the invention, inner slanted wall 37 extends between and connects bottom wall 33 and vertical wall 39. The top edge of inner slanted wall 37 intersects the edge of bottom wall 33 below side wall 25. The bottom edge of inner slanted wall 37 intersects vertical wall 39 below the intersection of outer slanted wall 35 and vertical wall 39.

While, in this embodiment of the invention, elongated ceiling grid member 21 includes outer slanted wall 35 and inner slanted wall 37 connecting threaded member receptacle 23 and vertical wall 39, in other embodiments of this invention, a single slanted wall or more than two slanted walls can connect the threaded member receptacle and the vertical wall.

Vertical wall 39 extends between and connects the lower edge of outer slanted wall 35 and the outermost edge of bottom wall 41. In this embodiment of the invention, vertical wall 39 is parallel to side walls 25 and 27 and spaced outwardly from side wall 25 in the lateral direction.

Vertical wall 39 includes score line 55. Score line 55 provides a reference line for screws connecting vertical wall 39 to a wall of a building or room. Specifically, an installer of a ceiling grid assembly that includes elongated ceiling grid member 21 can place a screw along score line 55 and tighten the screw to attach vertical wall 39 to the wall. Score line 55 helps prevent the screw from moving or "walking" along the inner vertical surface of vertical wall 39 when the installer starts to rotate the screw with a power drill or other tool.

Bottom wall 41 extends between and connects the lowermost edge of vertical wall 39 and lower slanted wall 43.

Lower slanted wall 43 includes upper sloped section 43, middle section 47 and lower section 49. Upper sloped section 45 extends between and connects vertical wall 39 and middle section 47. Middle section 47 extends between and connects upper sloped section 43 and lower section 49. Lower section 49 extends between and connects middle section 47 and bottom wall 41. Lower section 49 has top surface 50 configured to support a ceiling tile or other member.

Bottom wall 41 and lower slanted wall 43 form a lower portion of elongated ceiling grid member 21 that extends inwardly from vertical wall 39 in the lateral direction.

Finger or tab 51 extends downwardly from inner slanted wall 37. Finger or tab 53 extends upwardly from upper sloped section 45 of lower slanted wall 43. Fingers or tabs 51 and 53 are configured to receive and engage various types of clips that may be utilized in a ceiling assembly, such as seismic bracing clips.

In this embodiment of the invention, threaded member receptacle 23, outer slanted wall 35, inner slanted wall 37, vertical wall 39, bottom wall 41, lower slanted wall 43, finger or tab 51 and finger or tab 53 are integral and can be an extruded aluminum. In other embodiments of this invention, one or more of those members can be a separate member or separate members joined to the other members.

As stated, one embodiment of a connector for joining two elongated ceiling grid members 21 to form a corner of a ceiling grid assembly, corner connector 57, is illustrated in FIGS. 4-13.

Corner connector 57 includes first arm 59 and second arm 61. First arm 59 and second arm 61 are the same, as discussed below.

First arm 59 and second arm 61 include top wall 63, which, in this embodiment of the invention, is flat and extends along the top of each of first arm 59 and second arm 61.

Orifices 65, 67, 69, 71 and 73 are in top wall 63. Specifically, orifices 65 and 67 are in the portion of top wall 63 in first arm 59, orifices 71 and 73 are in the portion of top wall 63 in second arm 61 and orifice 69 is at the junction of first arm 59 and second arm 61.

Figure 12:
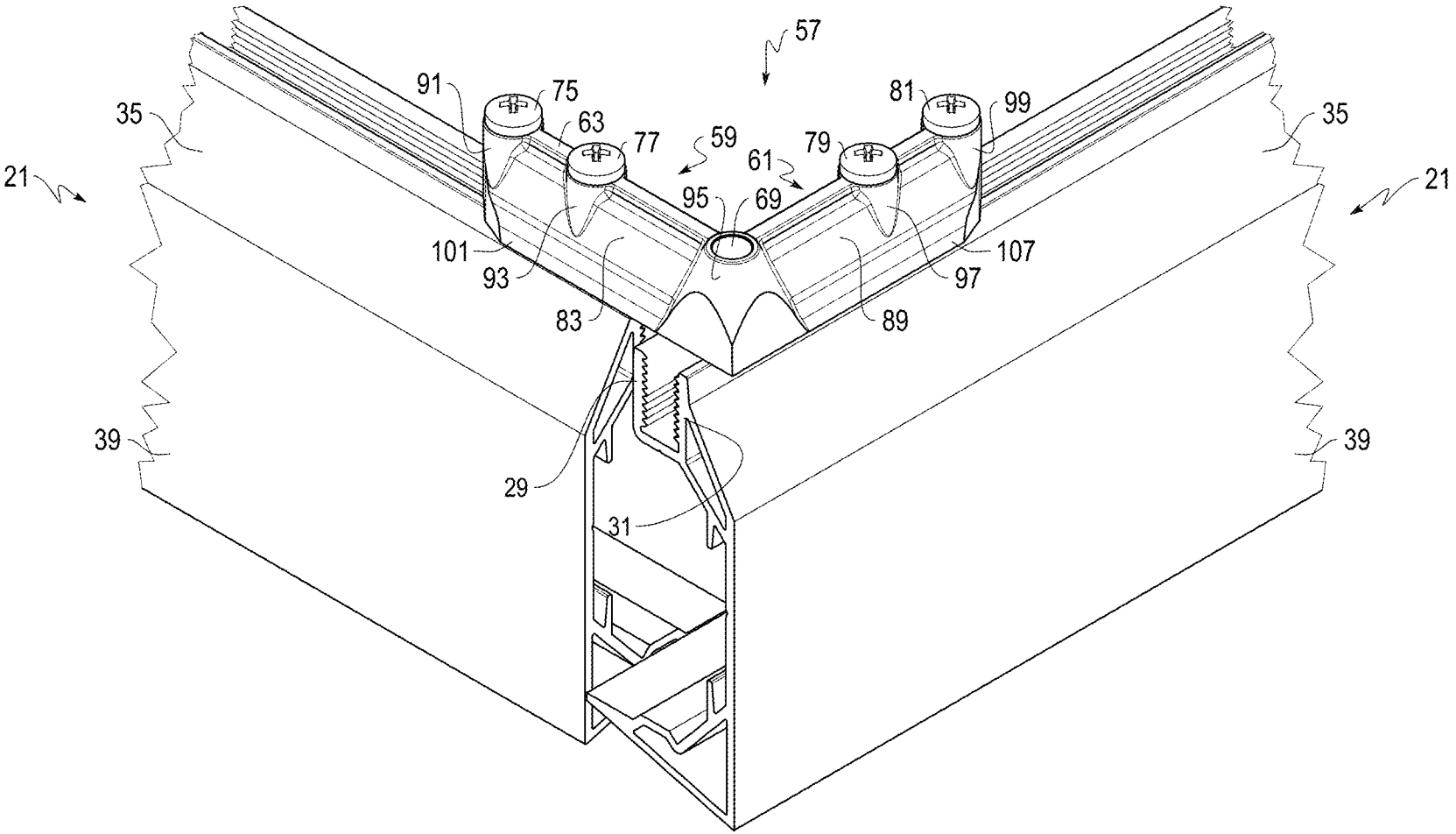
FIG. 12 is top, perspective view of the assembly of the corner connector illustrated in FIGS. 4-11 attached to two of the elongated ceiling grid member illustrated in FIGS. 1-3.
Figure 13:
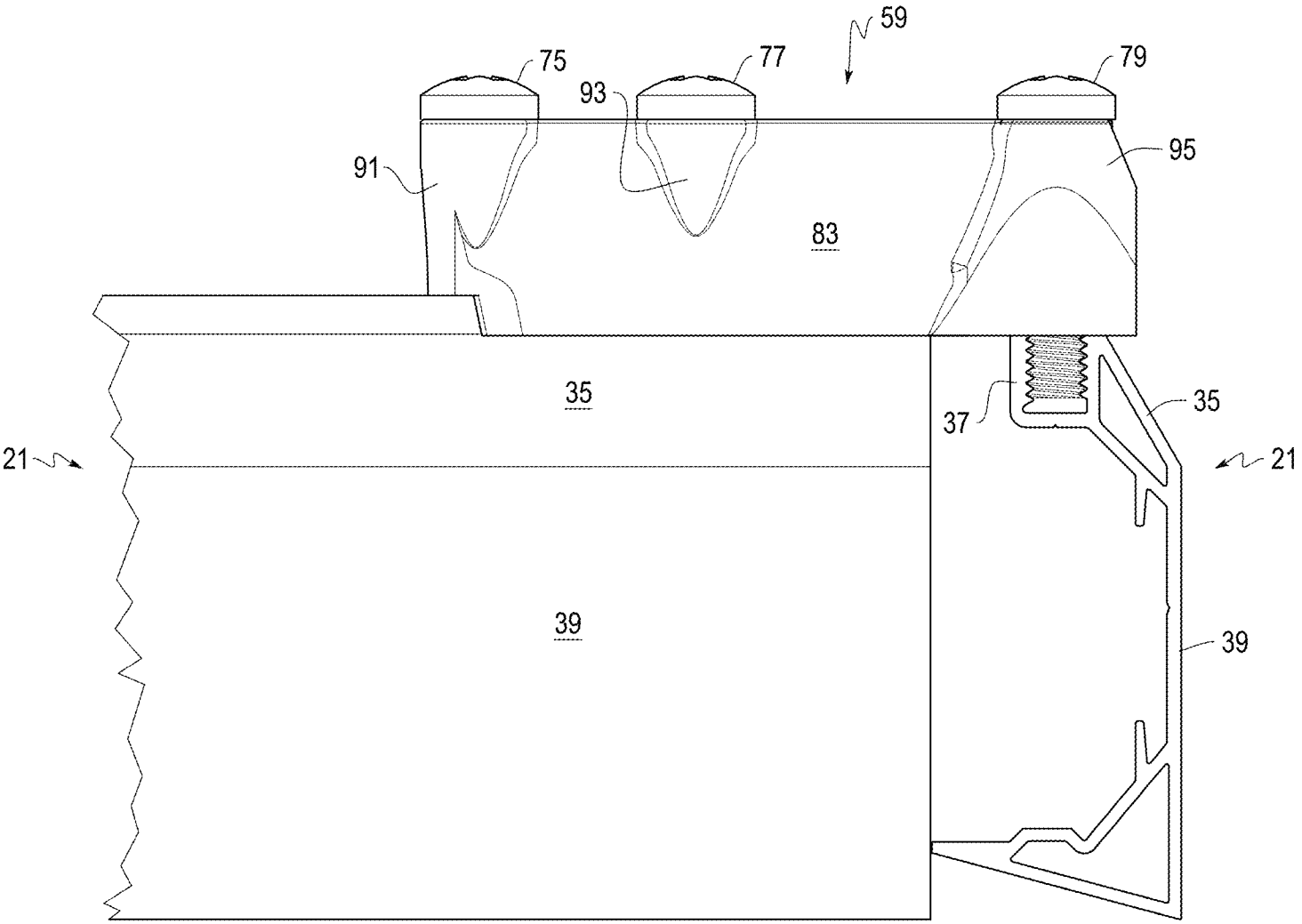
FIG. 13 is a front, elevation view of the assembly, illustrated in FIG. 12, of the corner connector illustrated in FIGS. 4-11 attached to two of the elongated ceiling grid member illustrated in FIGS. 1-3.
Figure 14:
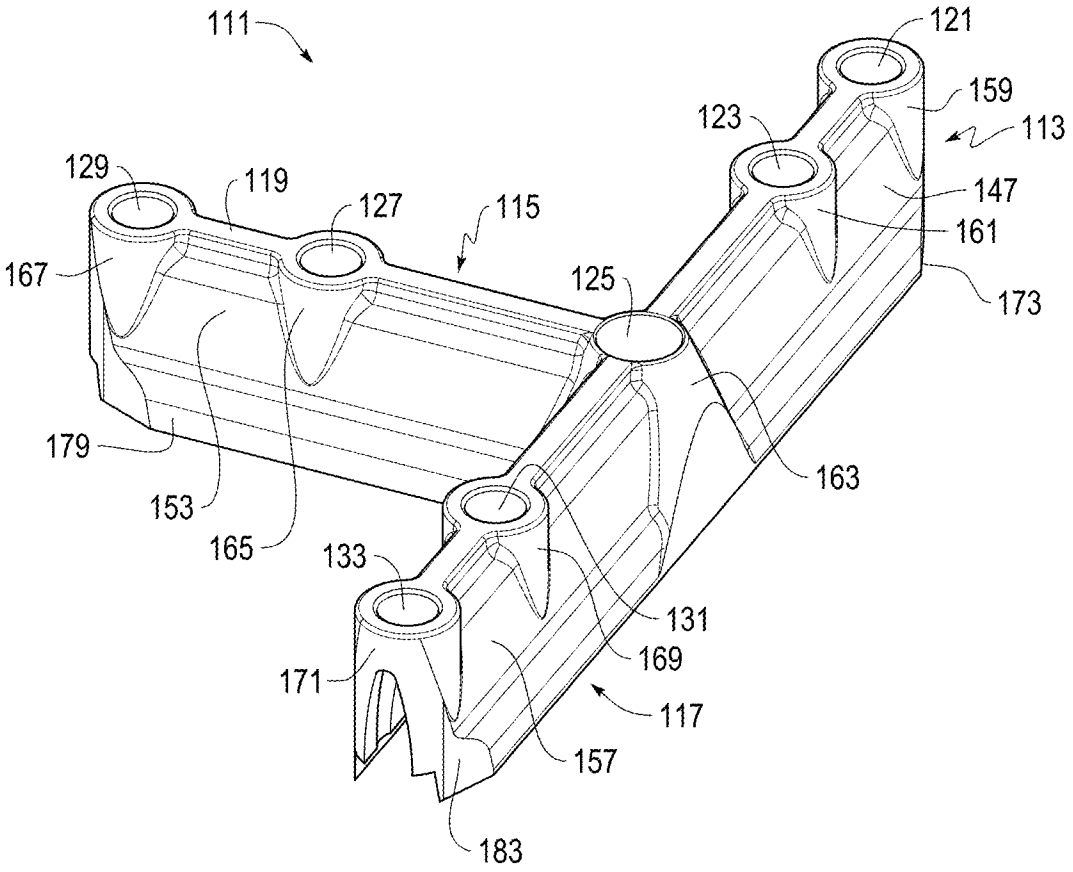
FIG. 14 is a top, perspective view of a T-connector that can connect one or two of the elongated ceiling grid member illustrated in FIGS. 1-3 and an "interior" elongated ceiling grid member in a T formation.
Figure 15:
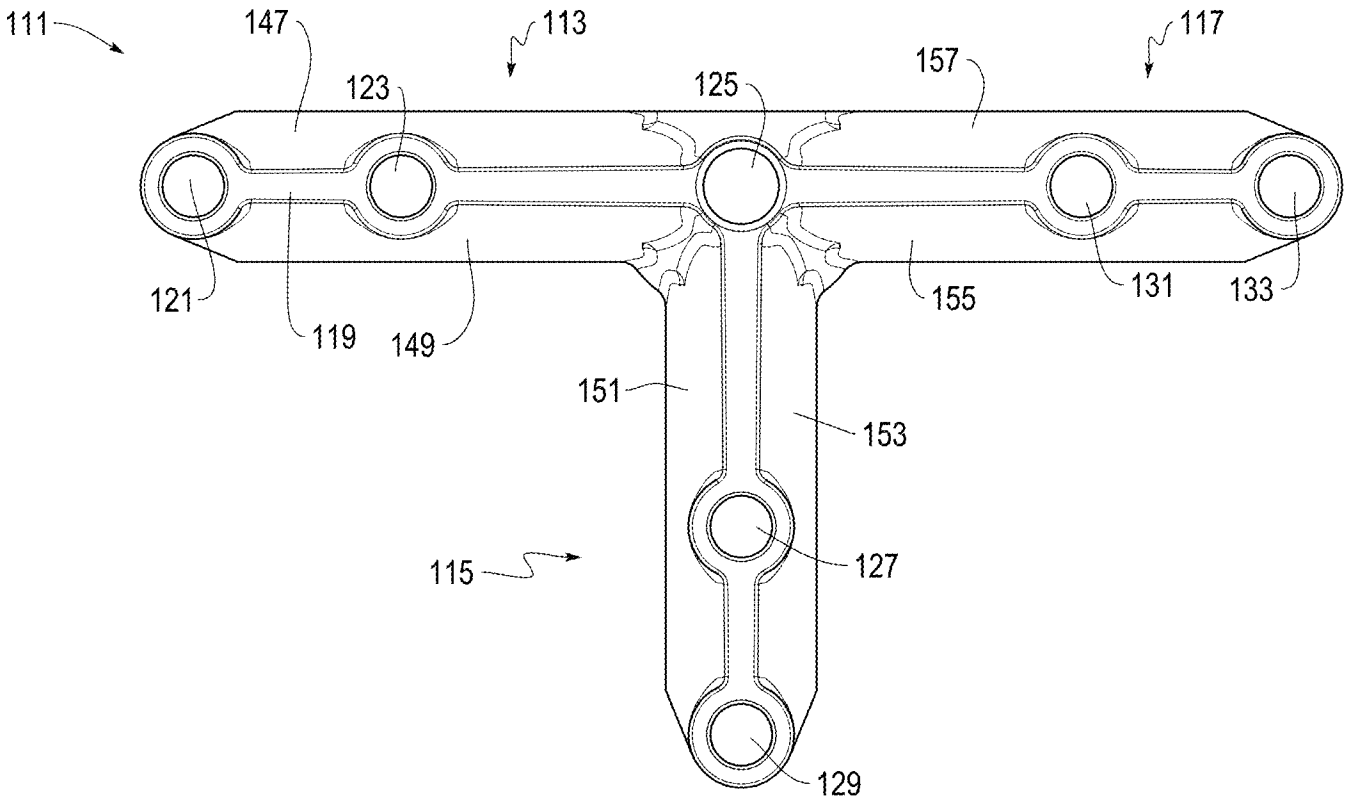
FIG. 15 is a top view of the T-connector illustrated in FIG. 14.
Figure 18:
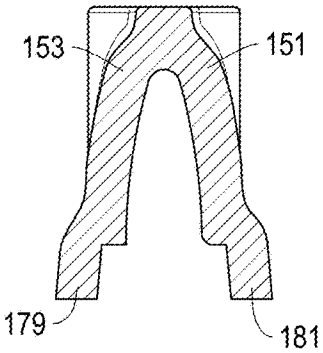
FIG. 18 is a cross-sectional view of the T-connector illustrated in FIGS. 14-17 taken along line 17-17 of FIG. 15.
Figure 17:
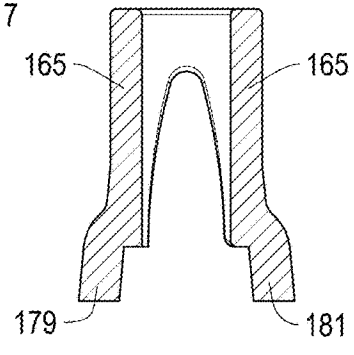
FIG. 17 is a cross-sectional view of the T-connector illustrated in FIGS. 14-16 taken along line 16-16 of FIG. 15.
Figure 16:
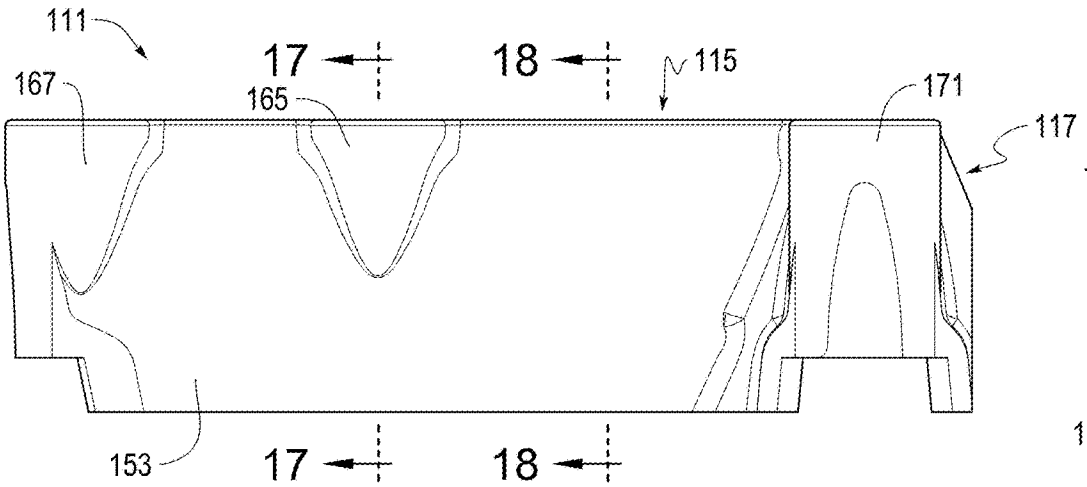
FIG. 16 is a side, elevation view of the T-connector illustrated in FIGS. 14 and 15.
Figure 19:
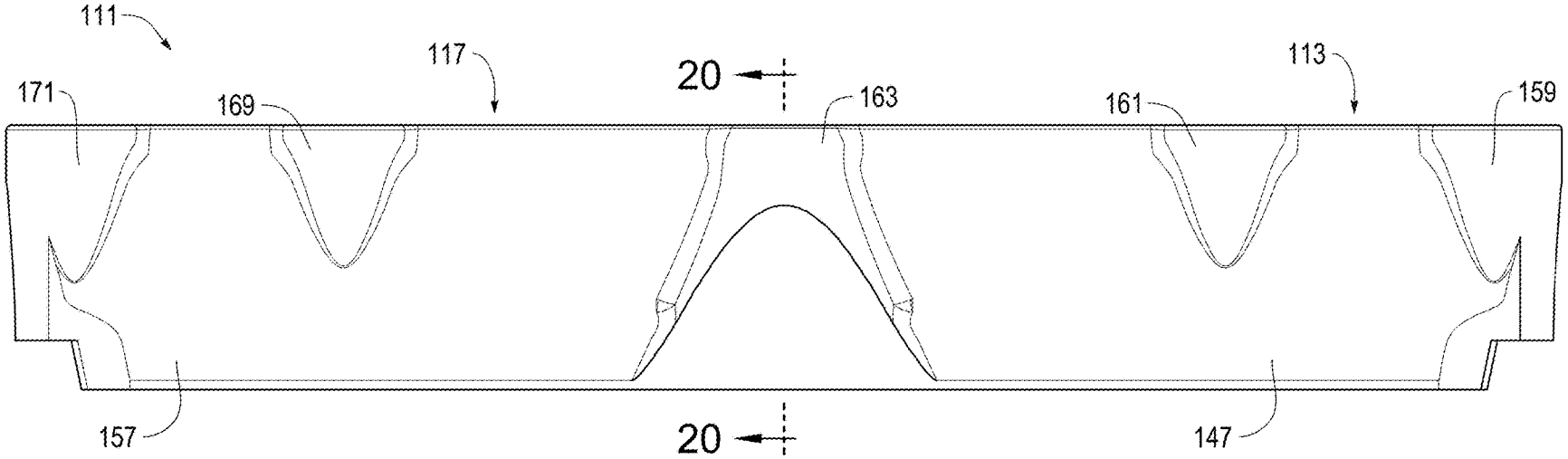
FIG. 19 is a front, elevation view of the T-connector illustrated in FIGS. 14-18.

Orifices 65, 67, 71 and 73 are configured to receive bolts or other fastening members, such as bolts 75, 77, 79 and 81, to attach corner connector 57 to two elongated ceiling grid members 21, as illustrated in FIGS. 12 and 13. Specifically, bolts 75, 77, 79 and 81 are inserted through orifices 65, 67, 71 and 73 and the threaded portions of those bolts are threadably received by threaded member receptacles 23 of the two elongated ceiling grid members 21.

Orifice 69 is configured to be machined to receive and engage a structural member, such as a rod, suspended from ceiling structure.

First arm 59 and second arm 61 each include side walls that extend downwardly from top wall 63. Specifically, first arm 59 includes side walls 83 and 85 and second arm 61 includes side walls 87 and 89.

Portions of side walls 83, 85, 87 and 89 have different slopes than the rest of those side walls. Those different-sloped portions form bubble portion 91 around orifice 65, bubble portion 93 around orifice 67, bubble portion 95 around orifice 69, bubble portion 97 around orifice 71 and bubble portion 99 around orifice 73. Those bubble portions provide added material around the respective orifices. That added material increase the "strength" of the bolt/orifice connections, which could be a weak point without the added material.

Each of side walls 83, 85, 87 and 89 includes a bottom tab. Specifically, side wall 83 includes bottom tab 101, side wall 85 includes bottom tab 103, side wall 87 includes bottom tab 105 and side wall 89 includes bottom tab 107. While, in this embodiment of the invention, bottom tabs 103 and 105 are continuous and bottom tabs 101 and 107 are continuous, in other embodiments of this invention, bottom tabs 103 and 105 can be spaced and bottom tabs 101 and 107 can be spaced.

Bottom tabs 101, 103, 105 and 107 are configured to receive threaded member receptacles 23 of elongated ceiling grid members 21 between them, as illustrated in FIGS. 12 and 13. Specifically, threaded member receptacle 23 of a first elongated ceiling grid member 21 is received between bottom tabs 101 and 103 and threaded member receptacle 23 of a second elongated ceiling grid member 21 is received between bottom tabs 105 and 107. The receipt of those threaded member receptacles 23 between the respective bottom tabs resists deformation of those receptacles under heavy loads.

As stated, a three arm connector that can be used to connect two of elongated ceiling grid member 21 and another type of an elongated ceiling grid member in a T formation is illustrated in FIGS. 14-23, three arm connector 111.

Figure 25:
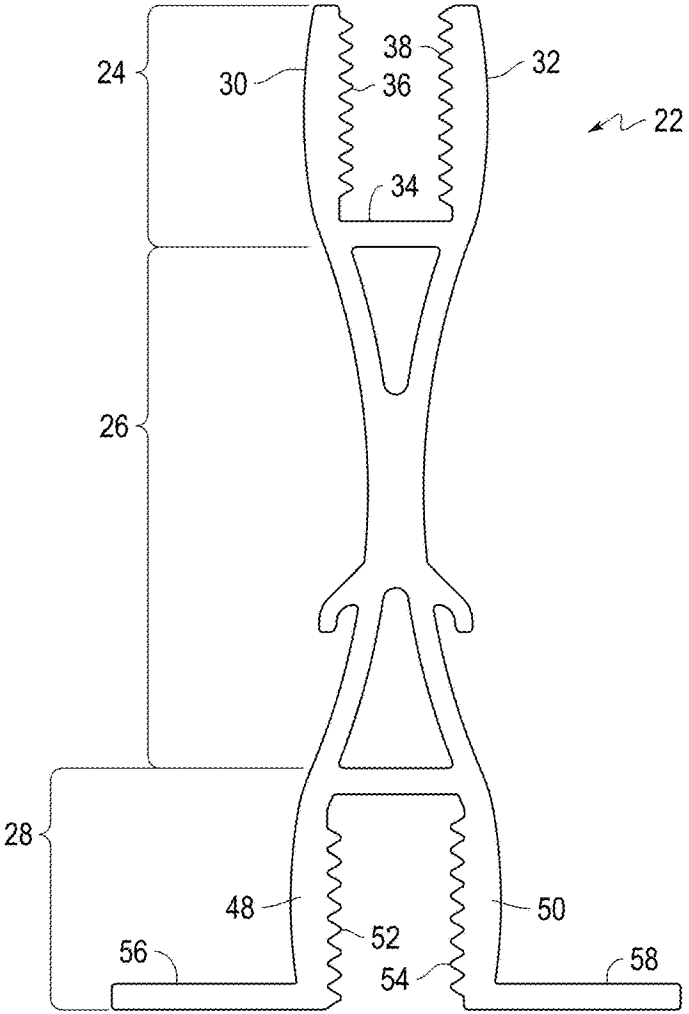
FIG. 25 is a front, elevation view of the "interior" elongated ceiling grid member illustrated in FIGS. 22-24.
Figure 24:
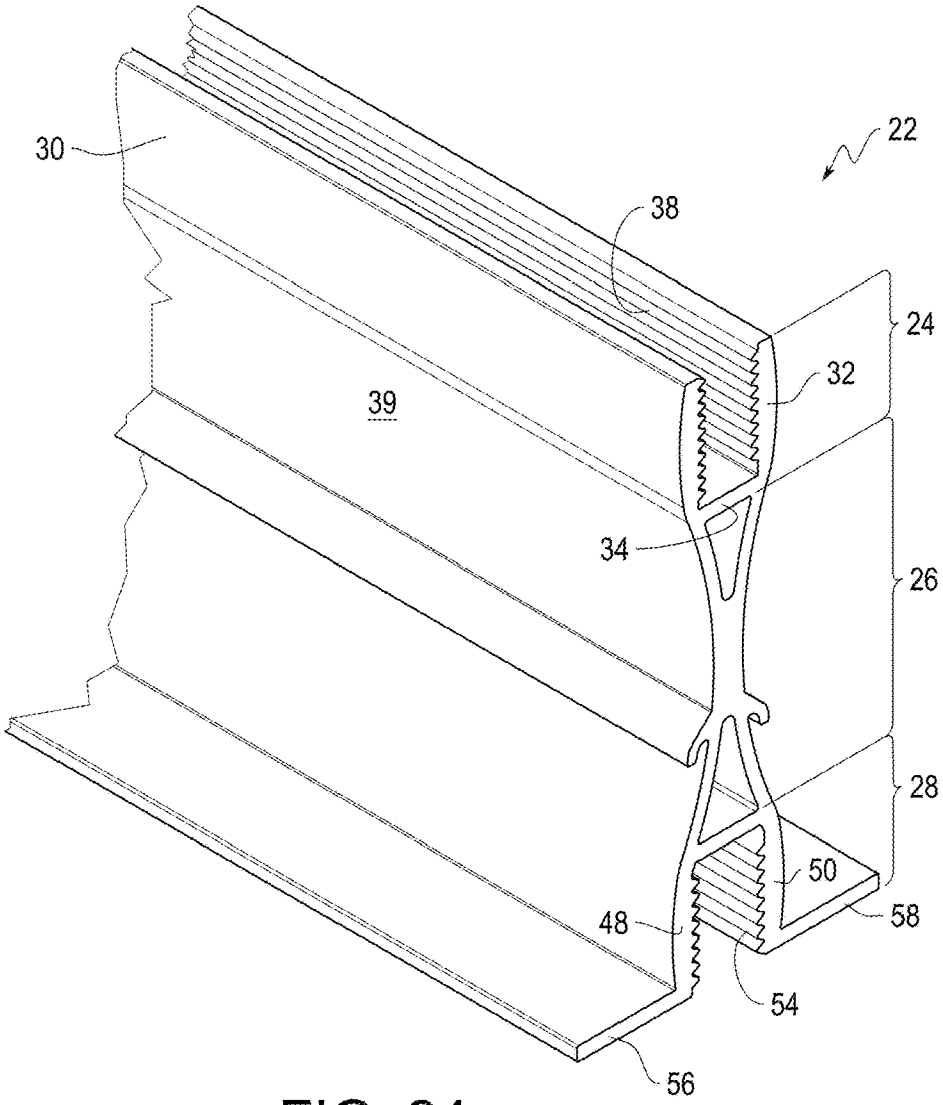
FIG. 24 is a side, perspective view of the "interior" elongated ceiling grid member illustrated in FIGS. 22 and 23.

An example of another type of an elongated ceiling grid member that can be connected to two of elongated ceiling grid member 21 by three arm connector 111 is elongated ceiling grid member 22, shown in FIGS. 24 and 25. Elongated ceiling grid member 22 is configured to be an "interior" grid member of a ceiling grid assembly.

Elongated ceiling grid member 22 includes, from top to bottom, upper portion 24, middle portion 26 and lower portion 28.

Upper portion 24 includes side wall 30, side wall 32 and bottom wall 34. Bottom wall 34 extends between and connects side walls 30 and 32.

Side wall 30 includes internal threads 36 and side wall 32 includes internal threads 38. Internal threads 36 and internal threads 38 are on parallel vertical surfaces and offset vertically so that a threaded member can be threadably received and retained between internal threads 36 and internal threads 38.

Lower portion 28 includes side wall 48, side wall 50, bottom flange 56 and bottom flange 58.

Side wall 48 and side wall 50 are parallel. Side wall 48 includes internal threads 52 and side wall 50 includes internal threads 54. Internal threads 52 and internal threads 54 are on parallel vertical surfaces and offset vertically so that a threaded member can be threadably received between internal threads 52 and internal threads 54.

Bottom flange 56 extends outwardly from the lowermost edge of side wall 48 and bottom flange 58 extends outwardly from the lowermost edge of side wall 50. In use, bottom flanges 56 and 58 can support ceiling tiles or other structural members.

Three arm connector 111 includes first arm 113, second arm 115 and third arm 117. Each of arms 113, 115 and 117 is the same, as discussed below.

First arm 113, second arm 115 and third arm 117 include top wall 119, which, in this embodiment of the invention, is flat and extends along the top of each of first arm 111, second arm 113 and third arm 115, as shown in the figures.

As shown in FIGS. 14-23, orifices 121, 123, 125, 127, 129, 131 and 133 are in top wall 119. Specifically, orifices 121 and 123 are in the portion of top wall 119 in first arm 113, orifices 127 and 129 are in the portion of top wall 119 in second arm 115, orifices 131 and 133 are in the portion of top wall 119 in third arm 117 and orifice 125 is at the intersection of arms 113, 115 and 117.

Figure 22:
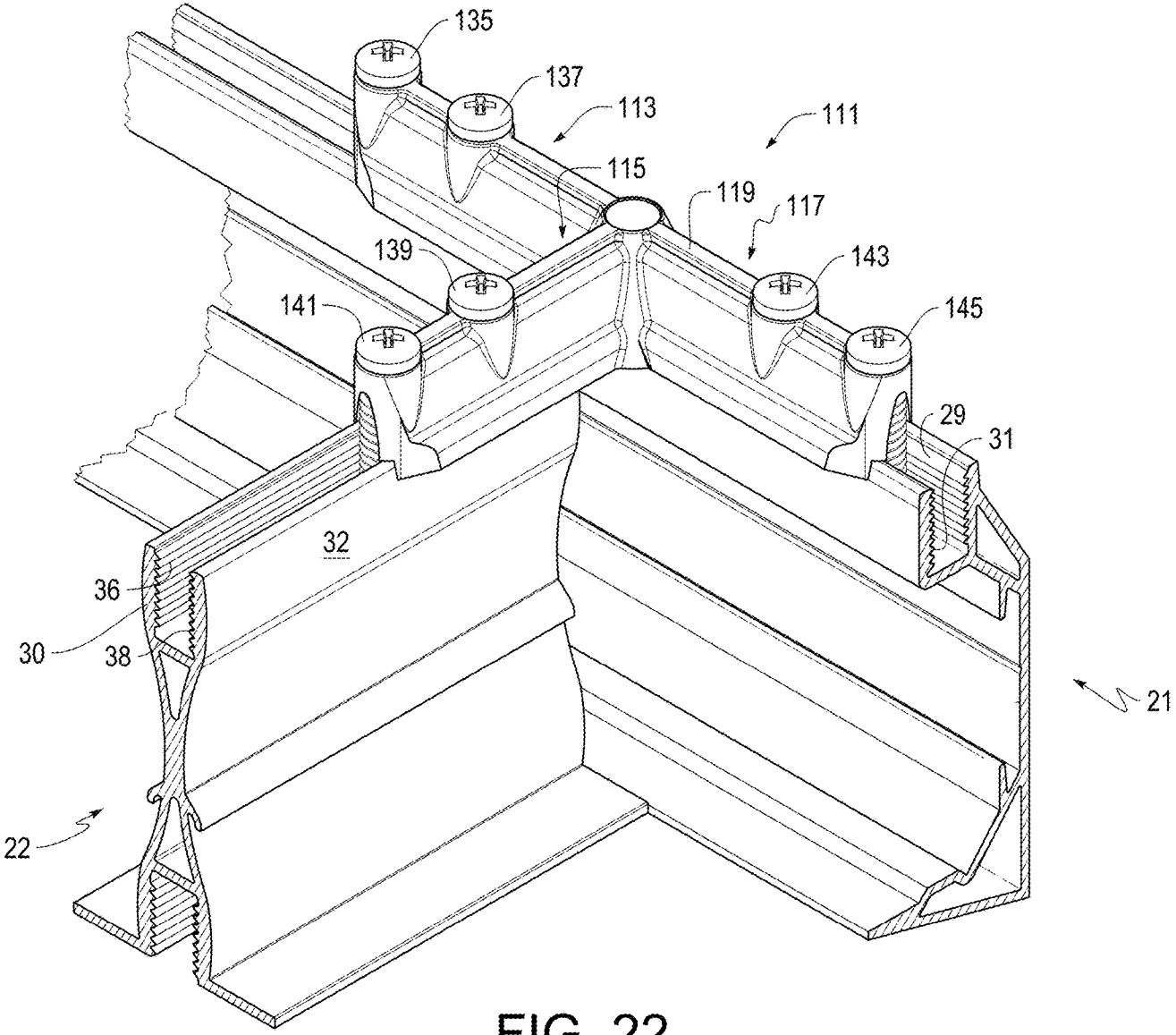
FIG. 22 is a top, perspective view of the assembly of the T-connector illustrated in FIGS. 14-21 attached to two of the elongated ceiling grid member illustrated in FIGS. 1-3 and the "interior" elongated ceiling grid member illustrated in FIGS. 24 and 25.
Figure 23:
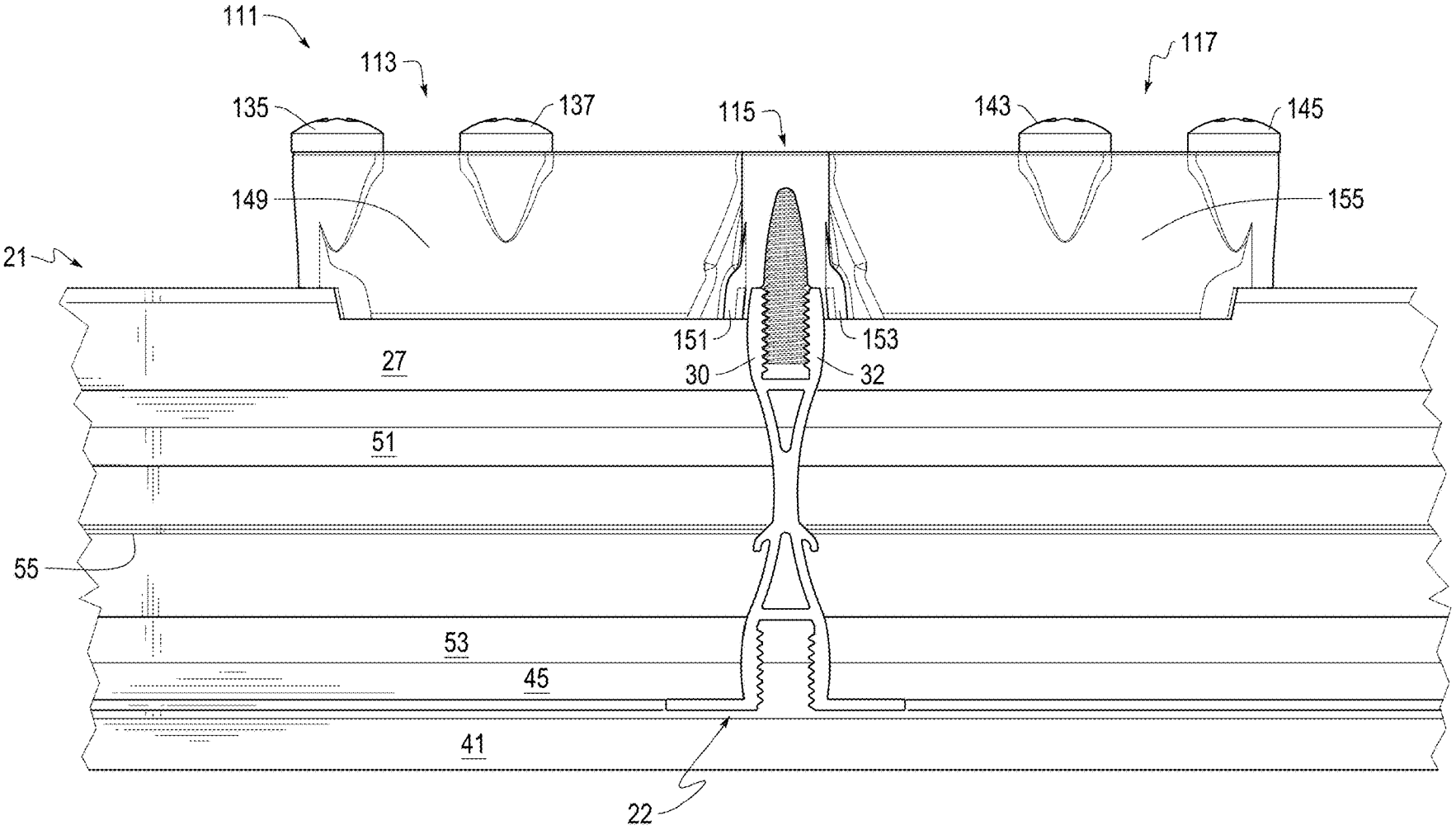
FIG. 23 is a side, elevation view of the assembly, illustrated in FIG. 22, of the T-connector illustrated in FIGS. 14-21 attached to two of the elongated ceiling grid member illustrated in FIGS. 1-3 and the "interior" elongated ceiling grid member illustrated in FIGS. 24 and 25.

Orifices 121, 123, 127, 129, 131 and 133 are configured to receive bolts or other fastening members to attach three arm connector 111 to two elongated ceiling grid members 21 and elongated ceiling grid member 22, as illustrated in FIGS. 22 and 23. Specifically, in this embodiment, bolts 135, 137, 139, 141, 143 and 145 are inserted through orifices 121, 123, 127, 129, 131 and 133, respectively, and the threaded ends of those bolts are threadedly engaged with the threaded member receptacles 23 of the two ceiling grid members 21 and upper portion 24 of elongated ceiling grid member 22.

Orifice 125 is configured to be machined to receive and engage a structural member, such as a rod, suspended from ceiling structure.

Each of first arm 113, second arm 115 and third arm 117 includes side walls that extend downwardly from top wall 119. Specifically, first arm 113 includes side walls 147 and 149, second arm 115 includes side walls 151 and 153 and third arm 117 includes side walls 155 and 157.

Portions of side walls 147, 149, 151, 153, 155 and 157 have different slopes than the rest of those side walls. Those different-sloped portions form bubble portion 159 around orifice 121, bubble portion 161 around orifice 123, bubble portion 163 around orifice 125, bubble portion 165 around orifice 127, bubble portion 167 around orifice 129, bubble portion 169 around orifice 131 and bubble portion 171 around orifice 133. Like bubble portions 91, 93, 95, 97 and 99 discussed above, bubble portions 159, 161, 163, 165, 167, 169 and 171 provide added material to "strengthen" the respective bolt/orifice connections.

Figure 21:
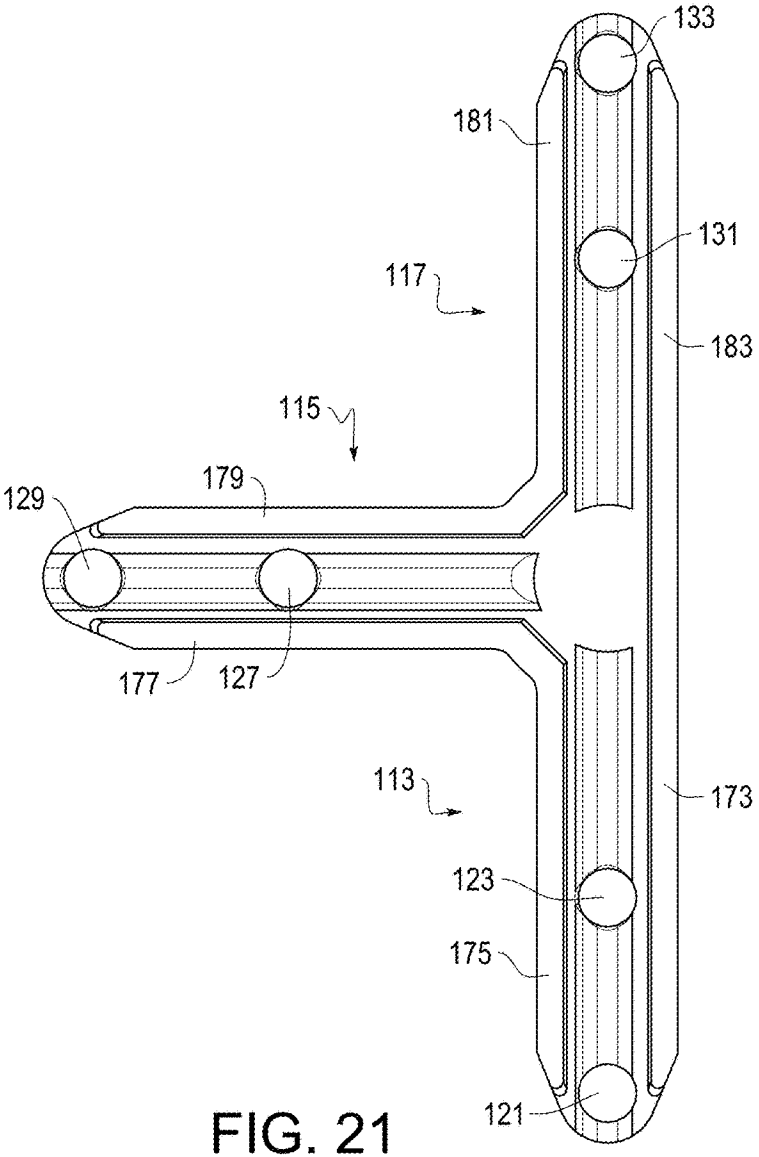
FIG. 21 is a bottom view of the T-connector illustrated in FIGS. 14-20.
Figure 20:
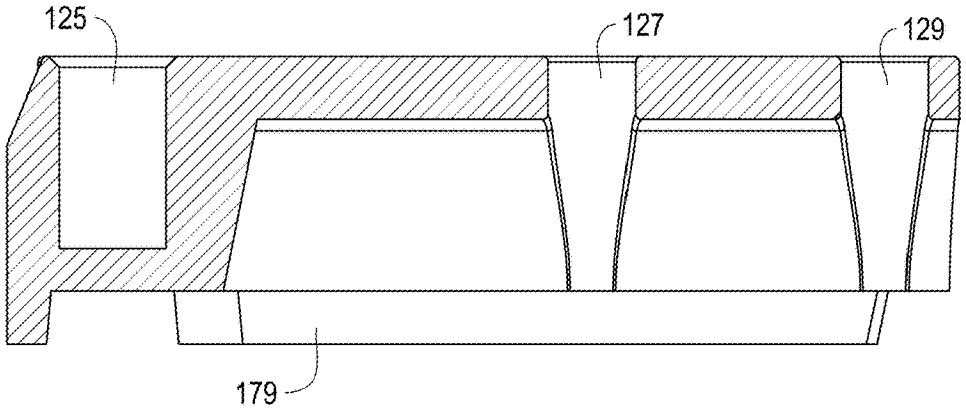
FIG. 20 is a cross-sectional view of the T-connector illustrated in FIGS. 14-19 taken along line 20-20 of FIG. 19.

Each of side walls include a bottom tab. Specifically, side wall 147 includes bottom tab 173, side wall 149 includes bottom tab 175, side wall 151 includes bottom tab 177, side wall 153 includes bottom tab 179, side wall 155 includes bottom tab 181 and side wall 157 includes bottom tab 183. While, in this embodiment of the invention and as shown in FIG. 21, bottom tabs 173 and 183 are continuous, as are bottom tabs 179 and 181 and bottom tabs 175 and 177, in other embodiments of the invention, bottom tabs 173 and 183, bottom tabs 175 and 177 and bottom tabs 175 and 177 can be spaced from each other.

Bottom tabs 173, 175, 177, 179, 181 and 183 are configured to receive threaded member receptacles 23 of elongated ceiling grid members 21 and upper portion 24 of elongated ceiling grid member 22 between them. Specifically, threaded member receptacle 23 of a first elongated ceiling grid member 21 is received between bottom tabs 173 and 175, upper portion 24 of elongated ceiling grid member 22 is received between bottom tabs 177 and 179, and threaded member receptacle 23 of a second elongated ceiling grid member 21 is received between bottom tabs 181 and 183. The receipt of those threaded member receptacles 23 and that upper portion between the respective bottom tabs resists deformation of those receptacles and that upper portion under heavy loads.

What is described and illustrated herein are preferred embodiments of the invention with some variations. The terms, descriptions and figures are for description and illustration of those preferred embodiments only and are not meant as limitations on the scope of this invention. Those skilled in the art will recognize that many different embodiments and variations beyond the specifically disclosed embodiments and variations are within the scope of the invention, as defined by the following claims.

What is claimed is:

1. An elongated ceiling grid member having a longitudinal axis in a longitudinal direction and comprising:

a threaded member receptacle having a pair of spaced side walls (a) extending in parallel in the longitudinal direction and spaced in a lateral direction perpendicular to the longitudinal direction and (b) threaded to threadedly receive and retain a first threaded member;

a vertical wall (a) parallel to the pair of spaced side walls and (b) spaced from the pair of spaced side walls in the lateral direction;

a first slanted wall (a) extending outwardly in the lateral direction and downwardly in a vertical direction perpendicular to the longitudinal direction and the lateral direction from one of the pair of spaced side walls and (b) joined to the vertical wall; and a lower portion (a) at a bottom of the vertical wall in the vertical direction, (b) extending inwardly from the vertical wall in the lateral direction and (c) configured to support a ceiling tile.

2. The elongated ceiling grid member according to claim 1, wherein the first slanted wall extends from the one of the pair of spaced side walls between an uppermost edge and a lowermost edge of the one of the pair of spaced side walls in the vertical direction.

3. The elongated ceiling grid member according to claim 2, further comprising a second slanted wall joined (a) at a first end to the one of the pair of spaced side walls below joinder of the first slanted wall and the one of the pair of spaced side walls in the vertical direction and (b) at a second end to the vertical wall below joinder of the first slanted wall and the vertical wall in the vertical direction.

4. The elongated ceiling grid member according to claim 3, wherein the second slanted wall joins the one of the pair of spaced side walls below a lowermost edge of the one of the pair of spaced side walls.

* * * * *